US005156689A

United States Patent [19]

Evans

[11] Patent Number: 5,156,689

[45] Date of Patent: Oct. 20, 1992

[54] NEAR NET SHAPE PROCESSING OF ZIRCONIUM OR HAFNIUM METALS AND ALLOYS

[75] Inventor: Steven C. Evans, Ogden, Utah

[73] Assignee: Westinghouse Electric Corporation, Pittsburgh, Pa.

[21] Appl. No.: 703,311

[22] Filed: May 20, 1991

[51] Int. Cl.[5] ..... C22F 1/00; C22C 16/00

[52] U.S. Cl. ..... 148/538; 148/565; 164/494; 164/495

[58] Field of Search ..... 148/2, 11.5 F; 164/494, 164/495

[56] References Cited

U.S. PATENT DOCUMENTS

| | | | |
|---|---|---|---|
| 4,627,148 | 12/1986 | Imahashi et al. | 164/495 |
| 4,794,979 | 1/1989 | Gassner et al. | 164/495 |
| 4,881,992 | 11/1989 | Bunel et al. | 148/11.5 F |
| 4,908,071 | 3/1990 | Anderson et al. | 148/11.5 F |
| 4,938,921 | 7/1990 | Mardon et al. | 420/422 |

*Primary Examiner*— Upendra Roy

[57] ABSTRACT

Zirconium or hafnium tubeshells, billets and channel sheets are produced by plasma arc melting the metal to form a liquid metal pool. The pool is poured into a mold to form a near net shape. The near net shape is reduced to final size while maintaining the metal temperature below the alpha-beta transition temperature throughout the size reducing step.

9 Claims, No Drawings

NEAR NET SHAPE PROCESSING OF ZIRCONIUM OR HAFNIUM METALS AND ALLOYS

This invention relates to a process for producing a metal shape from a plasma arc melted casting and, more particularly, to a process for producing zirconium and hafnium shapes from near net size castings.

BACKGROUND OF THE INVENTION

Current industrial practice in the manufacture of zirconium and hafnium semi-finished products such as tubeshells, billets and flat channel sheets typically involves a series of high temperature steps which employ high vacuums or protective non-oxidizing atmospheres. Broadly considered, ingots are melt consolidated by either multiple vacuum arc melting or electron beam melting. The ingots are then thermomechanically processed by heating the ingots well above the alpha-beta transition temperature and high temperature forging to intermediate shapes (frequently with one or more beta quenches) that will allow further mechanical working in the alpha temperature range. Advantageously, zirconium and hafnium may be processed in the alpha temperature range in air, whereas they must be protected by a non-oxidizing atmosphere when worked in the beta range.

It has been recently proposed to melt zirconium by plasma arc processes. See, e.g., D. Apelian et al., "Electron Beam Melting v. Plasma Melting: A Critical Review", Proceedings of the Conference entitled "Electron beam Melting and Refining, state of the Art 1984", pages 18–48. This disclosure, among other things, indicates that zirconium may be plasma arc melted using carbon electrodes and that titanium scrap and sponge may be plasma arc melted to form electrodes for subsequent vacuum arc remelting. This disclosure also briefly describes a Japanese titanium slab ingot facility wherein titanium sponge is plasma arc melted in a hearth and the melted titanium then poured into a mold having a continuous withdrawal mechanism to produce slab ingots (shown in FIG. 19). A plasma melting facility for processing titanium scrap and sponge is disclosed by G. Sick, "Large Scale Plasma Melting and Remelting Tests", Proceedings of the Vacuum Metallurgy Conference, 1986, and "Plasma Melting For Titanium and Superalloys", Proceedings of the Vacuum Metallurgy Conference, 1989.

As these disclosures generally indicate, plasma arc processes employ highly capital intensive facilities and high operating costs. Thus they have not been commercially suitable in the production of zirconium and hafnium.

SUMMARY OF THE INVENTION

It is an object of the present invention to provide a more cost efficient plasma arc process for producing zirconium and hafnium. It is another object of the present invention to eliminate the high (beta) temperature forging step which follows the casting step of present processes.

The present invention employs a plasma arc melting step in the production of zirconium and hafnium shapes, including tubeshells, billets, slabs, tubes and channel sheets. Advantageously, plasma melted metals and alloys are directly cast to near net shapes which then need only be alpha worked to the final shapes. Preferably, the near net shapes are beta heat treated and quenched before being alpha worked. Thus subsequent reheating and high temperature forging under nonoxidizing atmospheres is not required. As employed herein, the term "near net shape" means a shape which can be reduced to final size while maintaining the surface of the shape below the alpha-beta transition temperature.

In the practice of the present invention, zirconium, hafnium or an alloy thereof comprising at least about 90% (weight percent) of these metals is plasma arc melted to form a pool of liquid metal. The liquid metal is poured from the pool into a mold to form a near net shape. The near net shape is then reduced to a final size while maintaining its temperature below the alpha-beta transition temperature throughout the reduction step.

In a preferred practice a near net shape comprising at least about 90 w/o zirconium may be beta treated, quenched to below about 670° C. and reduced to a final shape while being maintained below about 670° C.

Other objects, advantages and benefits of the practice of the present invention will become more apparent from the following description of a preferred practice thereof.

DESCRIPTION OF A PREFERRED PRACTICE

In the preferred practice of the present invention, crushed zirconium sponge particles, from, e.g., a Kroll reduction process or from an acceptable recycle source, and alloying agents are fed to a hearth in a plasma arc furnace where the solids are melted and stirred by an arc to form a homogenized liquid metal pool. Zirconium alloys containing tin, iron, nickel and/or niobium such as, e.g., Zircaloy 2, Zircaloy 4 and Zirlo alloys available from the assignee of the present invention may be melted in this manner. Preferably, an inert gas such as argon or helium is employed in the plasma furnace to provide an inert atmosphere and also to melt and stir the melt. The atmospheric pressure in the plasma furnace is preferably slightly above the atmospheric pressure. Thus the pressure in the furnace may be about 1–5 psig. Advantageously, the relatively high pressure in the furnace (compared with electron beam furnaces) reduces the evaporation of metal alloying agents having high vapor pressures.

The metal in the pool is poured into a casting mold, by, e.g., flowing through a pouring nozzle or over a weir device from the hearth. Preferably the casting mold operates continuously and employs a withdrawal mechanism to withdraw the cast shape. In the manufacture of tubeshells for seamless tubing and similar products, the casting mold may comprise a water cooled mandrel in the center of an elongated mold. A hollow billet is then produced by the solidifying metal in a cavity between the mandrel and the mold cavity. Solid billets for bars, rods and similar products may be produced with the mandrel removed. Sheets for channels and similar products may be continuously cast into a bottomless mold having a generally rectangular cross section having an approximate width to thickness ratio of 4/1 or more.

The near net shapes are cooled to below the alpha-beta transition temperature in the casting mold or afterward. Most of the commercial zirconium alloys have a transition temperature greater than 670° C. Preferably, the shapes are beta quenched down to about 670° C. or less before the size reducing step.

The near net shapes are then reduced to final shapes (which may be semi-finished commercial products) below their transition temperatures. The reductions may vary from about a 1% sizing step up to several hundred percent engineering reduction. Advantageously, alpha working of zirconium and hafnium shapes may be performed in air without oxidizing the metal. Thus surface conditioning is normally unnecessary provided a suitable lubricant is employed.

Thus it will be seen that the practice of the present invention results in significant savings of material, energy and manpower. The shapes produced in accordance with the present invention have good chemistry control and homogeneity and require little if any finishing operations.

While certain objects, advantages and benefits of the preferred practice of the present invention have been described, it is to be distinctly understood that the present invention is not limited thereto but may be otherwise variously embodied within the scope of the following claims.

What is claimed is:

1. A process for producing a metal shape, comprising the steps of:

(a) plasma arc melting a metal selected from zirconium, hafnium and alloys thereof comprising at least about 90 w/o of these metals to form a liquid pool;

(b) pouring the metal from the pool into a mold to form a near net shape; and (c) reducing the metal from its near net shape to a final size while maintaining the metal temperature below the alpha-beta transition temperature throughout the size reducing step.

2. The process of claim 1, wherein the final shape is a tubeshell.

3. The process of claim 1, wherein the final shape is a hollow billet.

4. The process of claim 1, wherein the final shape is a solid billet.

5. The process of claim 1, wherein the final shape s a sheet.

6. The process of claim 1, wherein the final shape is a slab.

7. The process of claim 1, wherein the temperature of the as-cast shape is maintained below about 670° C. while reducing the as-cast shape to the final shape.

8. The process of claim 1, wherein the near net shape is heated to above the alpha-beta transition temperature before the reduction step.

9. The process of claim 8, wherein the near net shape heated above the alpha-beta transition temperature is quenched to below the transition temperature before the reduction step.

* * * * *